United States Patent [19]

Rolf

[11] 4,450,061

[45] May 22, 1984

[54] METAL STUB AND CERAMIC BODY ELECTRODE ASSEMBLY

[75] Inventor: Richard L. Rolf, New Kensington, Pa.

[73] Assignee: Aluminum Company of America, Pittsburgh, Pa.

[21] Appl. No.: 451,068

[22] Filed: Dec. 20, 1982

[51] Int. Cl.[3] ..... C25C 7/02; C25B 11/04; C25D 17/12

[52] U.S. Cl. ..... 204/286; 204/291; 204/297 R

[58] Field of Search ..... 204/288, 289, 286, 297 R, 204/291

[56] References Cited

U.S. PATENT DOCUMENTS

| | | | |
|---|---|---|---|
| 2,482,176 | 9/1949 | Hamister | 204/288 X |
| 2,805,879 | 9/1957 | Thomas | 204/288 X |
| 3,718,550 | 2/1973 | Klein | 204/67 |
| 3,960,678 | 6/1976 | Alder | 204/67 |
| 4,187,155 | 2/1980 | DeNora | 204/67 |

FOREIGN PATENT DOCUMENTS

| | | | |
|---|---|---|---|
| 258964 | 4/1967 | Austria | 204/286 |
| 53-25279 | 3/1978 | Japan | 204/286 |

OTHER PUBLICATIONS

Billehaug, Kari and Øye, H. A., "Inert Anodes for Aluminum Electrolysis in Hall-Hercoult Cells (I)," *Aluminum,* vol. 57, #2, 1981, pp. 146-150.

Billehaug, Kari and Øye, H. A., "Inert Anodes for Aluminum Electrolysis in Hall-Hercoult Cells (II)," *Aluminum,* vol. 57, #3, 1981, pp. 228-231.

*Primary Examiner*—Howard S. Williams
*Assistant Examiner*—T. L. Williams
*Attorney, Agent, or Firm*—Max L. Williamson

[57] ABSTRACT

An electrically conductive ceramic electrode body having an opening therein is threadably engaged with a metal stub having at least a slot therein to provide space for expansion of the stub without damage to the electrode body.

7 Claims, 3 Drawing Figures

METAL STUB AND CERAMIC BODY ELECTRODE ASSEMBLY

The Government has rights in this invention pursuant to Agreement No. DE-FC07-80CS40158 awarded by the U.S. Department of Energy.

BACKGROUND OF THE INVENTION

This invention relates to a method of connecting a metallic electrical conductor to an electrically conductive ceramic electrode body to make an electrode assembly which is suitable for use in producing metal by electrolysis.

A number of materials including metals such as aluminum, lead, magnesium, zinc, zirconium, titanium and silicon, for example, can be produced by electrolytic processes. Although individual processes may vary in some respects from one to another, each employs the use of an electrode which must operate in a highly corrosive environment.

An example of such a process for the production of metal is the well-known Hall-Heroult process (hereinafter referred to as the Hall process) for producing aluminum in which alumina dissolved in a molten fluoride salt bath is electrolyzed at temperatures from 900° C. to 1000° C. In the process as generally practiced today, carbon is used as an anode to reduce the alumina, and the reduction produces molten aluminum, and the carbon is oxidized to primarily form $CO_2$ which is given off as a gas. Despite the common usage of carbon as anode material in practicing the Hall process, there are a number of disadvantages to its use.

Since carbon is consumed in relatively large quantities in the Hall process, approximately 420 to 550 kg per ton of aluminum produced, the anode must be constantly repositioned or replenished to maintain the proper spacing with the cathode in the cell to produce aluminum efficiently. If prebaked anodes are used, it may be seen that a relatively large facility is needed to produce sufficient anodes to operate an aluminum smelter. Furthermore, to produce the purity of aluminum required to satisfy primary aluminum standards, the anode must be relatively pure carbon, and availability and cost of raw materials to make the carbon are of increasing concern to aluminum producers.

Because of the disadvantages inherent in the use of carbon as an anode, there has been a continuing search for inert or nonconsumable materials that can operate as an anode with a reasonable degree of electrochemical efficiency and withstand the high temperature and extremely corrosive environment of the molten salt bath. A number of different types of materials have been suggested and tried, including ceramic oxides, metals and ceramic transition metal borides and carbides, and gaseous fuels, such as natural gas or hydrogen, as the reactant in a fuel-cell type anode. From published literature, few, if any, materials tried will survive for a prolonged time in an aluminum electrolysis cell; however, some ceramic oxides have been reported to be corrosion resistant during cell operation. A recent review of literature and patents relating to inert anodes for use in producing aluminum may be found in articles entitled "Inert anodes for aluminum electrolysis in Hall-Heroult cells (I)" by Kari Billehaug and H. A. Øye, Volume 57, #2, Aluminium, 1981, and "Inert anodes for aluminum electrolysis in Hall-Heroult cells (II)" by Kari Billehaug and H. A. Øye, Volume 57, #3, Aluminium, 1981.

A major problem in the development and use of nonconsumable anodes for producing aluminum by electrolysis has been that of providing a satisfactory method for making a connection between an electrically conductive ceramic material and a metal conductor leading from the cell to a power source. In a typical operation of a Hall cell using carbon as the anode, the anode is formed into a block having a rectangular cross section and a metallic rod or bar is embedded therein by providing a hole in the block, inserting the rod in the hole and filling the void between the rod and the block with molten iron. When the iron solidifies, it shrinks tightly around the bar and away from the hole surfaces of the carbon block, but disengagement is prevented by adapting the block so as to engage the solidified iron. Such an adaptation is providing recesses in the hole side wall, for example. When the above-described assembly is positioned in a Hall cell having a salt bath which is maintained at approximately 1000° C., the rod, cast iron and carbon in the connection zone rise in temperature from room temperature to approximately 700° to 800° C. The rod, cast iron and carbon in the connection zone expand due to this temperature rise and a substantially tight and reasonably efficient electrical connection is effected. Because the rod and cast iron are relatively free to expand longitudinally, the principal electrical contact between the body and the metal due to the thermal expansion is along the lateral surfaces.

When ceramic materials are used for anode bodies, however, such a connection is not satisfactory for a number of reasons.

When using carbon as the anode body, it is desirable that it be in a block form because it is consumed during the electrolytic process and a large block or mass minimizes the frequency with which anodes must be replaced. It is not desirable, on the other hand, to provide an anode of ceramic materials in a large mass or block because, typically, ceramic anode bodies are more expensive to make than are carbon anode bodies, and the carbon materials are typically better conductors of electricity than are ceramic materials used in inert anodes.

As has been previously noted, the carbon anode to metal bar connection utilizing cast iron as the connecting medium relies primarily upon the lateral surfaces of the cast iron being in substantially tight contact with the lateral surfaces adjacent the hole in the carbon block to effect a reasonably satisfactory electrical connection. Variations in electrical conductivity of such a connection due to such things as irregularities in the cast iron and carbon block surfaces, for example, may be tolerated because of the relatively short time span over which an individual carbon block functions as an anode. In the case of an anode made from ceramic materials, however, most of the ceramic materials which are suitable for use as anodes are less efficient electrical conductors than carbon and, furthermore, to be effective, the anode must function over an extended period of cell operation time. Assuring a continuous intimate contact between the ceramic anode body and metal conductor is considered to be more critical, therefore, than the contact required between a carbon block and metal conductor.

Ideally, the connection of a nonconsumable anode material to a metal conductor for use in the electrolytic production of metal must be corrosion resistant, have a minimal voltage drop across the connection, and function to maintain the integrity of the ceramic material when subjected to temperature differentials on the order of 1000° C.

A number of methods for making connections of ceramic materials to metal conductors in the electrolytic production of aluminum have been proposed. Klein U.S. Pat. No. 3,718,550 proposes three different methods. In one of the methods, a ceramic anode tube, having a closed end, contains molten silver and a titanium carbide rod connected to a current supply extends down into the molten silver pool. In a second method, the inner surface of the tube is covered with a thin layer of silver or platinum and a hollow cylinder of nickel-alloy wire mesh is inserted into the tube to contact the silver or platinum layer and is connected with nickel-alloy wires to a conductor leading to the current supply. In the third method, the closed-end ceramic anode tube contains nickel powder, and a rod of zirconium diboride connected to a conductor leading to the current supply is inserted into the nickel powder. Alder U.S. Pat. No. 3,960,678 shows ceramic anode bodies of various shapes in contact with the electrolyte. Adjacent to the anode, but not in contact with the electrolyte, is a material designated as a current distributor which may be a metal such as Ni, Cu, Co, Mo or molten silver or a nonmetallic material such as a carbide, nitride or boride. Power leads connected to the current distributor may be made of the same materials, and it is suggested that the current distributor and power lead may be a single piece. The patentee does not describe how the various connections are to be made. De Nora et al U.S. Pat. No. 4,187,155 suggests attaching lead-in connectors to ceramic electrodes by fusing the connector into the electrode during the molding and sintering process or by making an attachment after sintering, but does not describe any method for making such attachments so as to avoid fracture of the ceramic in use.

It would be desirable, therefore, to provide a method for joining a ceramic body to a metal conductor for use in producing metal by electrolysis.

SUMMARY OF THE INVENTION

In this invention an electrically conductive ceramic electrode body having an opening therein is assembled with a closed end tubular, cup-shaped metal member by providing a threaded connection between the body and metal member, for example. Projecting upwardly from the interior surface of the bottom wall of the cup-shaped metal member a metal rod is provided as a suspension means and for connection to a power source. The tube wall provides compliance for expansion in the radial direction. A plurality of vertical slots in the tubular wall of the metal member enables the metal member to expand in a circumferential direction and vertical expansion is accommodated by providing proper interlocking thread design. Radial expansion may be accommodated by making the tube wall thin enough to be flexible at the cell operating temperature. In assembling the metal member with the electrode body, the exterior surface of the bottom wall of the cup-shaped member is placed in intimate contact with the electrode surface adjacent the bottom of the opening to insure optimum current distribution.

The ceramic electrode body may be comprised of any materials suitable for use in making an electrode for use in producing a metal by electrolysis, and the metal stub may be made from any conductive metal that is nonreactive and compatible with the electrode body in a particular metal producing cell environment.

After assembling the electrode body with the stub and conductor rod, the electrode body is suspended in the electrolyte bath by clamping or otherwise attaching the free end of the conductor rod to an overhead support system and the conductor rod is attached to a power source. Preferably, the entrance to the opening in the electrode body is suspended above the cell bath level to guard against corrosive attack of the metal components from the electrolyte or products of electrolysis. As a further corrosion preventive measure, a protective cover made of corrosion resistant material and having an opening therethrough to accommodate the conductor rod may be provided over the electrode body opening.

It is an object of this invention to provide a reliable, electrically efficient connection between a ceramic electrode body and a metal conductor which can accommodate expansion of the metal conductor due to temperature differentials encountered in producing metals by electrolysis.

This and other objects and advantages of this invention will be more apparent with reference to the following description of a preferred embodiment and accompanying drawings.

DESCRIPTION OF A PREFERRED EMBODIMENT

For convenience purposes, a preferred embodiment of this invention will be described with reference to an anode assembly for producing aluminum by an electrolytic process. It is to be understood, however, that the scope of this invention is intended to include its use in producing other metals by electrolysis as well.

Figure 1:
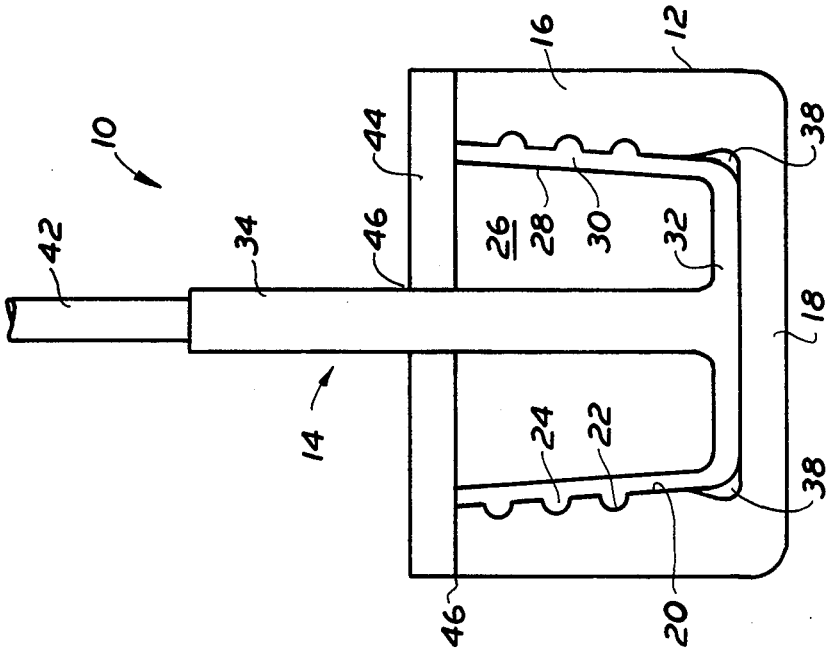
FIG. 1 is a cross-sectional elevation view of an electrode assembly of this invention.

The anode assembly 10, shown in cross section in FIG. 1, is comprised of an electrically conductive ceramic anode body 12 and a metal stub subassembly 14. The anode body 12 is a cylinder, closed at one end, having a generally cylindrical wall 16 and a circular end wall 18. The interior surface 20 of side wall 16 is tapered for convenience in molding but may optionally be essentially vertical. Thread depressions 22 are provided along the interior surface 20 of the side wall 16 to assemble with cooperating threads 24 of the metal subassembly 14. Although the anode body of this preferred embodiment is shown as a generally cylindrical closed end tube, it is apparent that the body might have any shape or configuration having an opening 26 therein to accommodate the metal subassembly 14.

The metal stub 14 is comprised of a generally cylindrical closed end tube 28 having a generally cylindrical side wall 30 and circular bottom end wall 32 and a metal conductor rod 34 projecting upwardly from a central portion of the bottom end wall of the closed end tube. Around the outer surface of the side wall 30, threads 24 are provided to engage the depressions 22 in the anode body 12. The general shape of the closed end tubular member is determined by the general shape of the opening 26 in the anode body 12 to allow engagement with allowance for expansion, as will be explained later.

To insure optimum electrical conductivity through the connection, surfaces of the stub 14 and anode body 12 in contact with one another should be smooth and uniform, having a 30 RMS finish, for example.

The ceramic anode body may be comprised of any ceramic materials suitable for use in making an anode for the electrolytic production of metal. One composition suitable for the practice of this invention, for example, is 20% by weight Fe, 60% by weight NiO and 20% by weight $Fe_3O_4$. To prepare the body, the above materials in a powder form are mixed and placed in a mold to produce the desired shape of the body. The molded shape is then reaction sintered in an argon atmosphere at a temperature of approximately 1275° C. for approximately four hours under a pressure of approximately 25,000 psi (172 MPa).

The metal stub 14 may be made of any metal that is electrically conductive and compatible with the ceramic anode body 12. If the body is comprised of the Fe, NiO and $Fe_3O_4$ noted above, a nickel alloy is suitable for use in making the stub. The stub 14 may be made in one piece, such as a casting or machining from bar stock, for example, or as an alternative, the rod 34 may be attached to the closed end tube 28 by any convenient means, such as welding, for example.

Figure 3:
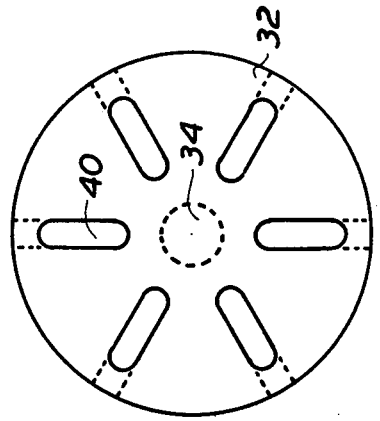
FIG. 3 is a bottom view of the stub shown in plan in FIG. 2.
Figure 2:
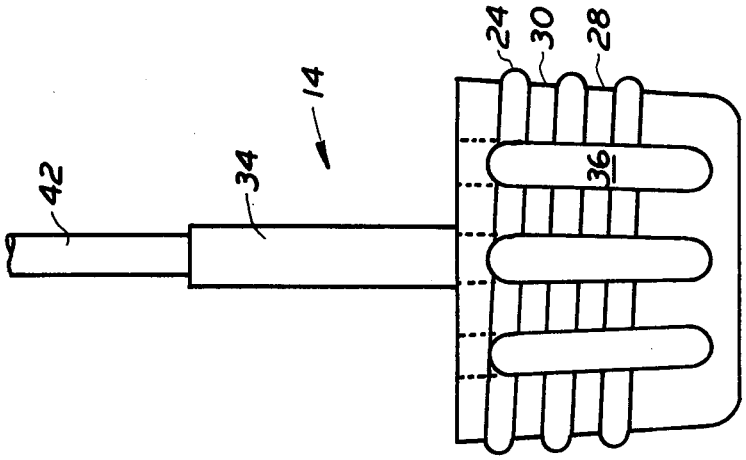
FIG. 2 is an elevation view of the metal stub portion of the electrode assembly shown in FIG. 1.

As shown in FIG. 2, a plurality of slots 36 extend vertically upward in the side wall 30 from the bottom wall 32 of the tubular member 28. It is apparent, however, that a single slot 36 of appropriate width might also be used to accommodate circumferential expansion of the stub side wall 30. As shown, the slots 36 may be completely enclosed, or as an alternative, the slots may extend for the full length of the side wall as shown by the dotted lines. As the tubular member 28 expands from the effect of a temperature differential of approximately 1000° C. in producing aluminum by electrolysis, the slots 36 provide a space to accommodate the circumferential expansion of the metal. To allow for vertical expansion of the tubular member 28, the thread 24 and depressions 22 in the anode body 12 are dimensioned to allow sufficient clearance between the thread and depessions at the anticipated temperature rise of approximately 1000° C. The required clearance can be calculated by determining the difference in expansion of the ceramic and metal materials over the anticipated temperature differential of approximately 1000° C. To accommodate radial expansion of the tubular member 28 adjacent the end wall 32, an annular space 38 may be provided between the periphery of the end wall and the anode body 12. Radial expansion may be further accommodated by making the cylindrical side wall 30 thin enough to be flexible at the cell operating temperature and still carry any mechanical and thermal stresses.

To provide optimum current distribution across the end wall 18 of the anode body 12, it is preferable that the end wall 32 of the tubular member 28 be a solid planar disc. It is apparent, however, that a slot 40 or plurality of slots extending radially from a central portion of the end wall 32 could be provided, if necessary, to allow additional space for exapnsion of the end wall with a small sacrifice in current distribution. As is the case with the vertical slots 36, the slots 40 may extend, if desired, completely through the outer edge of the end wall as indicated by the dotted lines.

In using the anode-stub assembly 10 to produce aluminum by electrolysis, a power lead 42 is attached to the conductor rod 34 and the assembly 10 is suspended in an electrolyte bath comprised of 80.7% by weight cryolite, 12.4% by weight $AlF_3$, 5.0% by weight $CaF_2$ and 1.9% by weight $Al_2O_3$. The assembly is suspended with the entrance to the opening 26 above the bath level. Although not considered essential in the operation of a production cell, as a measure of protection against corrosion, a suitable cover 44 made of boron nitride, for example, may be provided across the opening. The seams 46 between the cover 44 and anode body 12 and between the cover and metal conductor 34 may be sealed with a boron nitride paste.

To produce aluminum, the cell would be typically operated with an anode-to-cathode distance of approximately 1½ inches (38 mm) and with the bath at a temperature of 960° C. and a current density of 6.5 amp/in$^2$ (1 amp/cm$^2$).

While the invention has been described in terms of preferred embodiments, the claims appended hereto are intended to encompass all embodiments which fall within the spirit of the invention.

What is claimed is:

1. An electrode assembly comprising:

an electrically conductive ceramic electrode body having an opening therein;

a metal stub comprising a cup having an end wall and a side wall projecting upwardly therefrom at least partially within the body opening and attached to said body opening with attaching means; and expansion and contraction means within said stub to allow said stub to expand and contract without cracking or otherwise fracturing said body.

2. An assembly as described in claim 1 wherein said metal stub further comprises a rod projecting upwardly from a central portion of the end wall.

3. An assembly as described in claim 1 wherein the attaching means comprises a continuous thread on the exterior of the side wall, the thread adapted to engage with a continuous groove in the side wall defining the opening in said stub.

4. An assembly as described in claim 1 wherein said expansion and contraction means comprises at least one slot in the side wall, the slot extending upwardly from the end wall.

5. An assembly as described in claim 1 wherein said expansion and contraction means comprises at least one slot in the end wall extending radially from a central portion of the end wall.

6. An electrode assembly comprising:

an electrically conductive ceramic electrode body having a circular opening therein with a continuous spiral groove in a substantially vertical side wall defining the opening;

a metal stub at least partially within the body opening, said stub having a circular end wall, a substantially vertical side wall projecting upwardly from the end wall with the side wall having a continuous spiral thread projecting outwardly therefrom and in engagement with the groove in the body opening; and at least one slot in the side wall of said stub, the slot projecting upwardly from the end wall.

7. An assembly as described in claim 6 which further comprises at least one slot in the end wall of said stub, the slot projecting outwardly from a central portion of the end wall.

* * * * *